US005692826A

United States Patent [19]

Hsien-Jung

[11] Patent Number: 5,692,826

[45] Date of Patent: Dec. 2, 1997

[54] NEON LIGHT ASSEMBLY

[76] Inventor: Huang Hsien-Jung, P.O. Box 82-144, Taipei, Taiwan

[21] Appl. No.: 670,825

[22] Filed: Jun. 20, 1996

[51] Int. Cl.[6] ..... F21V 15/04

[52] U.S. Cl. ..... 362/191; 362/390; 362/263; 362/806; 362/216; 362/397

[58] Field of Search ..... 362/363, 190, 362/191, 20, 186, 196, 200, 267, 310, 806, 390, 263, 216, 397, 194, 195, 369; 40/541, 545, 564

[56] References Cited

U.S. PATENT DOCUMENTS

| | | | |
|---|---|---|---|
| 1,973,455 | 9/1934 | Wilkinson | 362/390 |
| 3,500,378 | 3/1970 | Pickering et al. | 362/186 |
| 4,387,416 | 6/1983 | Decker | 362/190 |
| 4,482,941 | 11/1984 | Lindner | 362/190 |
| 5,117,345 | 5/1992 | Baake | 362/390 |
| 5,412,547 | 5/1995 | Hornblad et al. | 362/253 |
| 5,440,464 | 8/1995 | Nowlin et al. | 362/190 |
| 5,446,634 | 8/1995 | Okubo | 362/806 |
| 5,558,428 | 9/1996 | Lehrer et al. | 362/186 |

*Primary Examiner*—Thomas M. Sember
*Attorney, Agent, or Firm*—Alfred Lei

[57] ABSTRACT

A neon light assembly includes a base provided with a switch and a first electrical socket on its vertical wall and a second electrical socket on its center a transparent casing provided with a first electrical plug engageable with the second electrical socket of the base, and a neon light fitted within the transparent casing and electrically connected with the electrical plug.

2 Claims, 5 Drawing Sheets

NEON LIGHT ASSEMBLY

BACKGROUND OF THE INVENTION

1. Field of the Invention

This invention relates to a neon light assembly.

2. Description of the Prior Art

It has been found that the conventional neon light on the market is limited in use and mostly designed for use with sign boards only. Therefore, it is an object of the present invention to provide a neon light assembly which can be used as a personal decoration.

SUMMARY OF THE INVENTION

This invention relates to a neon light assembly.

It is the primary object of the present invention to provide a neon light assembly which can be used as a personal decoration.

It is another object of the present invention to provide a neon light assembly which is simple in construction and compact in size.

It is still another object of the present invention to provide a neon light assembly which is of much fun in use.

It is still another object of the present invention to provide a neon light assembly which is low in cost.

It is a further object of the present invention to provide a neon light assembly which is easy to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
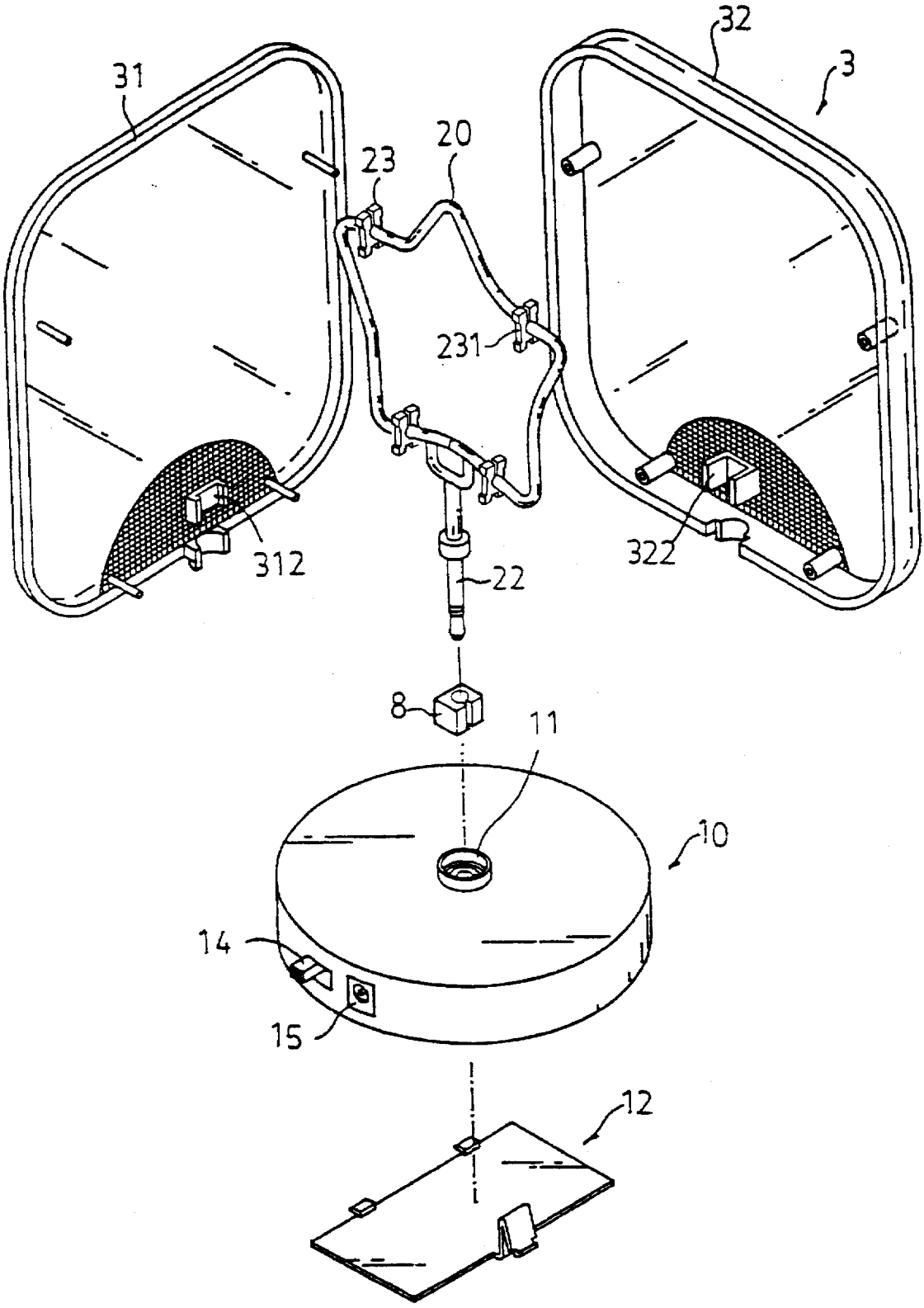
FIG. 1 is an exploded view of a neon light assembly according to a first preferred embodiment the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
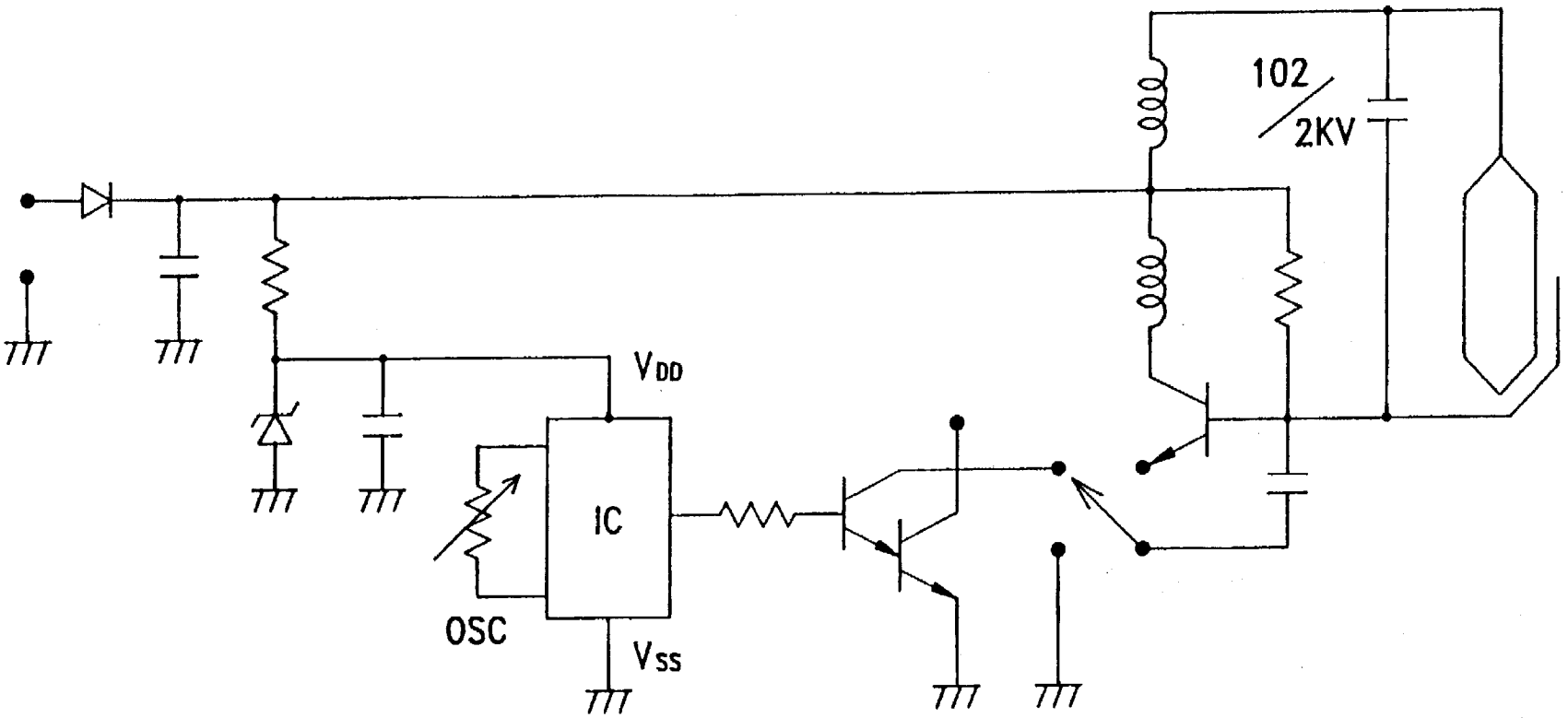
FIG. 2 shows the electrical circuit of the neon light assembly.
Figure 3:
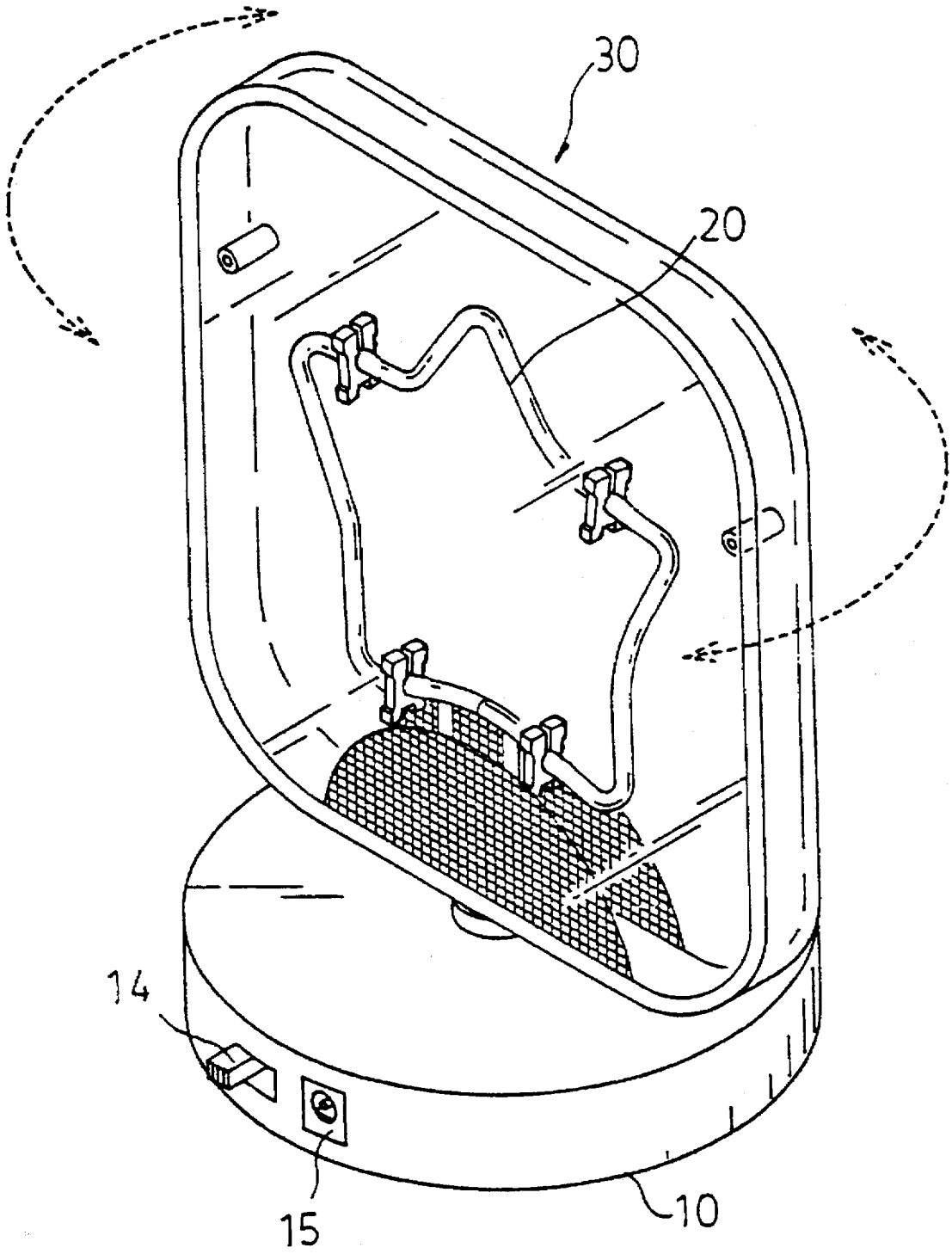
FIG. 3 is a perspective view of the neon light assembly shown in FIG. 1.

With reference to the drawings and in particular to FIGS. 1, 2 and 3 thereof, the neon light assembly according to the present invention mainly comprises a base 10, a transparent casing 3, and a neon light 20.

The base 10 is provided with a switch 14 and a first electrical socket 15 at its vertical side wall, a second electrical socket 11 at the center of its top, and a battery chamber (not shown) at its bottom. The battery chamber is provided with a cover 12.

The transparent casing 3 includes a front cover 31 and a rear cover 32 adapted to engage with the front cover 31. The front cover 31 has a first gripping portion 312 at its inner side. The rear cover 32 has a second gripping portion 322 at its inner side adapted to engage with the first gripping portion 312.

The neon light 3 is provided with a plurality of cushioning members 23 for absorbing the shock between the neon light 20 and the casing 3. Each of the cushioning members 23 has two shoulder portions 231 at two vertical opposite sides. Further, the lower end of the neon light 20 is fixedly and electrically connected with a first electrical plug 22 which is adapted to engage with the second electrical socket 11 of the base 10.

A rectangular member 8 made of resilient material such as rubber or the like is put on to the upper portion of the first electrical plug 22 and sandwiched between the first gripping portion 312 and the second gripping portion 322.

An electrical circuit (shown in FIG. 2) is arranged within the base 10 and electrically connected with the switch 14 and the first socket 15. The electrical circuit is designed so that the neon light can be controlled to give light in flash mode or non-flash mode as desired. However, the electrical circuit may be of any conventional design which is well known to those skilled in the art and is not considered a part of the invention.

Figure 4:
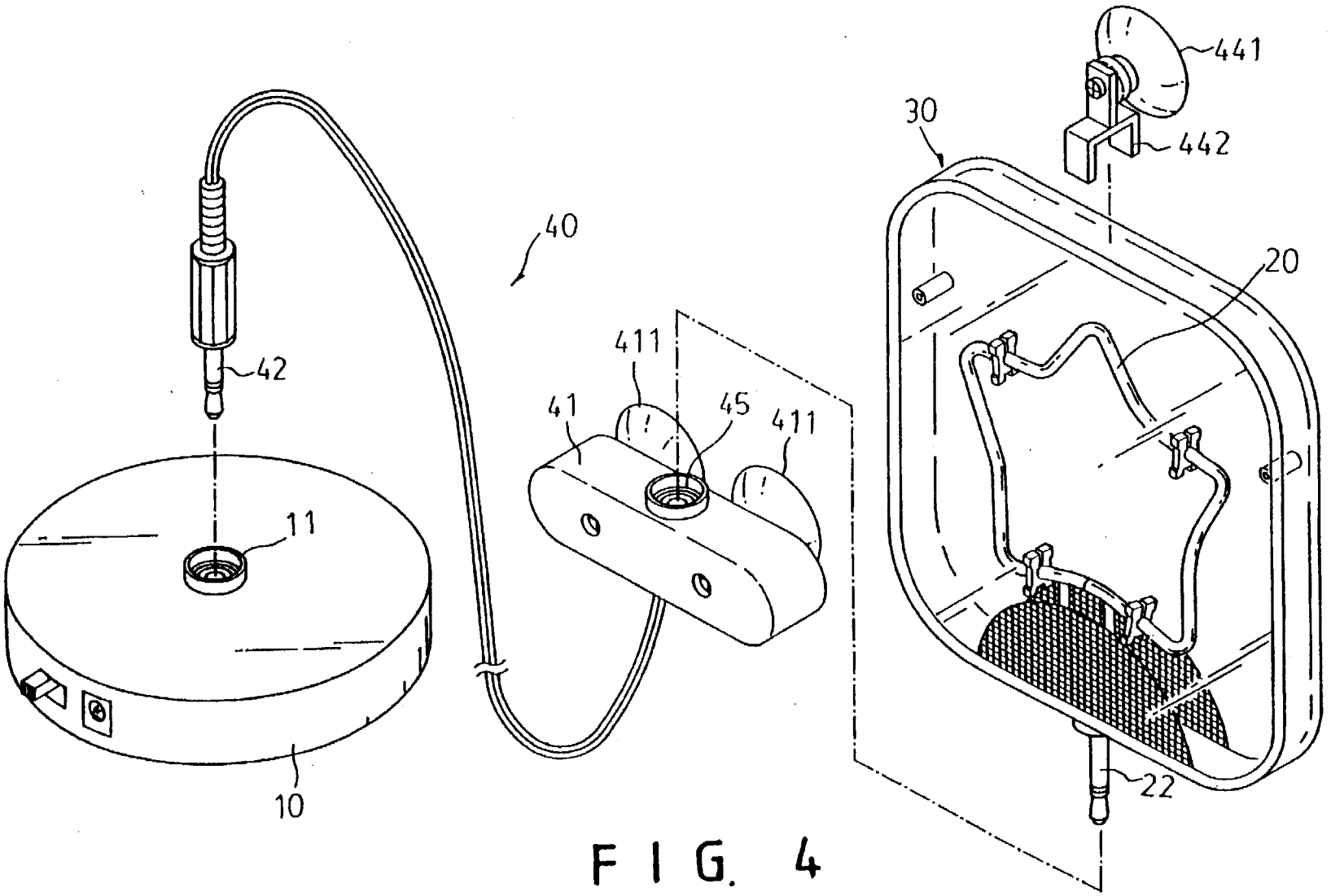
FIG. 4 is an exploded view of a neon light assembly according to a second preferred embodiment of the present invention.
Figure 5:
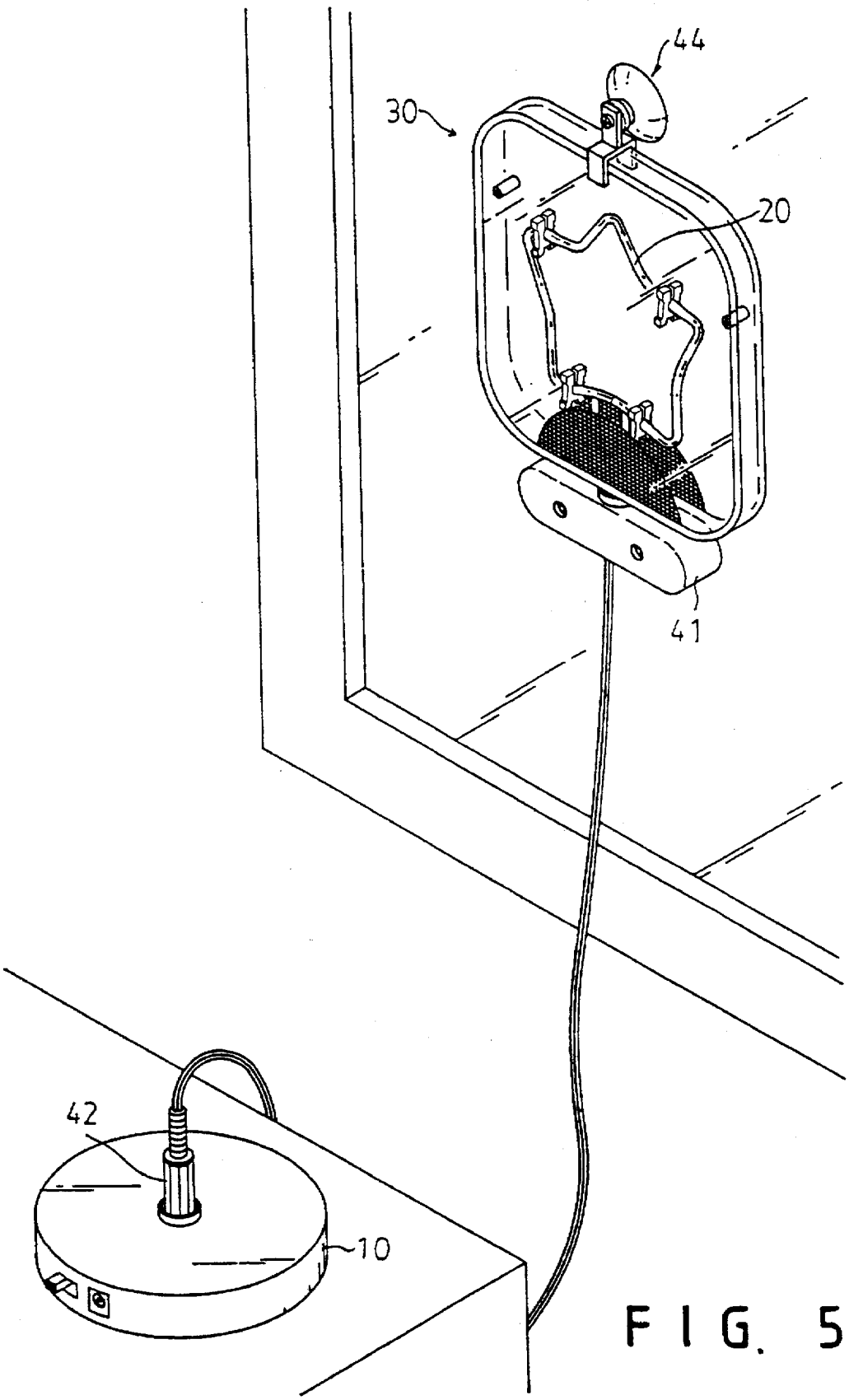
FIG. 5 is a perspective view of the neon light assembly according to the second preferred embodiment.

FIGS. 4 and 5 illustrate a neon light assembly according to the second preferred embodiment of the present invention. As shown, the neon light assembly further comprises a connector 40 which is provided at an end with a second electrical plug 42 engageable with the second electrical socket 11 of the base 10 and at another end with a seat 41 having a pair of first suction cups 411 and a third electrical socket 45 engageable with the first electrical plug 22 of the neon light 20. Further, a second suction cup 441 having a bracket 442 is engageable with the transparent casing 3. Hence, the transparent casing 3 together with the neon light 20 can be conveniently mounted on a vertical wall or the like.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A neon light assembly comprising:

a base provided with a switch and a first electrical socket at a vertical side wall thereof, a second electrical socket at a center thereof, and a battery chamber at a bottom thereof, said battery chamber being provided with a cover;

a transparent casing including a front cover and a rear cover adapted to engage with said front cover, said front cover having a first gripping portion at an inner side thereof, said rear cover having a second gripping portion at an inner side thereof adapted to engage with said first gripping portion;

a neon light provided with a plurality of cushioning members for absorbing shock between said neon light and the inner sides of said casing, each of said cushioning members having two shoulder portions at two vertical opposite sides thereof, a lower end of said neon light being fixedly and electrically connected with a first electrical plug adapted to engage with said second electrical socket of said base; and a rectangular member made of resilient material connected to an upper portion of said first electrical plug and sandwiched between said first gripping portion and said second gripping portion.

2. The neon light assembly as claimed in claim 1, further comprising an electrical connector having an end with a second electrical plug engageable with said second electrical socket of said base and another end with a seat having two first suction cups and a third electrical socket engageable with said first electrical plug of said transparent casing, and a second suction cup having a bracket engageable with an upper side of said transparent casing.

* * * * *